US006546585B1

(12) United States Patent
Blaustein et al.

(10) Patent No.: US 6,546,585 B1
(45) Date of Patent: Apr. 15, 2003

(54) TOOTHBRUSH WITH DETACHABLE/ REPLACEABLE HEAD

(75) Inventors: Lawrence A. Blaustein, Moreland Hills, OH (US); John Osher, Moreland Hills, OH (US); John R. Nottingham, Hunting Valley, OH (US); John W. Spirk, Gates Mills, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/347,773

(22) Filed: Jul. 6, 1999

(51) Int. Cl.[7] ..... B25G 3/18; A46B 7/04

(52) U.S. Cl. ..... 15/167.1; 15/176.1; 15/176.6; 15/145; 403/329; 403/DIG. 14; 132/321

(58) Field of Search ..... 15/167.1, 167.2, 15/176.1, 176.6, 202, 145, 194; 601/139, 141; 132/321, 328, 308, 309, 310; 403/329, 325, DIG. 14, 321

(56) References Cited

U.S. PATENT DOCUMENTS

| | | | | | |
|---|---|---|---|---|---|
| 1,774,283 | A | * | 8/1930 | Manning | 403/329 |
| 1,859,425 | A | * | 5/1932 | Bell | 403/329 |
| 2,950,134 | A | * | 8/1960 | Strange | 403/329 |
| 3,072,938 | A | * | 1/1963 | Phaneuf | 403/329 |
| 3,369,265 | A | * | 2/1968 | Halberstadt et al. | 15/176.6 |
| 3,738,762 | A | | 6/1973 | Moore et al. | 401/186 |
| 3,749,503 | A | | 7/1973 | Duerr | 401/195 |
| 3,755,848 | A | | 9/1973 | Mutrie | 15/167.1 |
| 3,991,776 | A | | 11/1976 | Duffy | 132/84 |
| 4,598,437 | A | * | 7/1986 | Ernest et al. | 15/167.1 |
| 4,683,604 | A | | 8/1987 | Rueb | 15/176.1 |
| 4,850,735 | A | * | 7/1989 | Hansen et al. | 403/329 |
| 4,890,349 | A | | 1/1990 | Nitzsche | 15/176.5 |
| 5,058,230 | A | | 10/1991 | Hodosh et al. | 15/176.1 |
| D323,745 | S | | 2/1992 | Stuart | D4/104 |
| D336,368 | S | | 6/1993 | Bickell | D4/104 |
| 5,224,234 | A | | 7/1993 | Arsenault et al. | 15/176.1 |
| 5,247,716 | A | | 9/1993 | Hock | 15/176.6 |
| 5,247,718 | A | | 9/1993 | Victorian | 15/176.1 |
| 5,253,948 | A | * | 10/1993 | Butler | 15/176.6 |
| 5,369,831 | A | * | 12/1994 | Bock | 15/167.1 |
| 5,396,679 | A | | 3/1995 | Brown et al. | 15/176.4 |
| 5,412,831 | A | | 5/1995 | Mongelluzzo | 15/176.1 |
| 5,555,590 | A | | 9/1996 | Blum et al. | 15/176.4 |
| D378,250 | S | | 3/1997 | Marchello | D4/104 |
| 5,737,792 | A | | 4/1998 | Quigless | 15/176.6 |
| 5,875,510 | A | * | 3/1999 | Lamond et al. | 15/176.6 |
| 6,145,152 | A | * | 11/2000 | Ward | 15/176.1 |

* cited by examiner

*Primary Examiner*—Gary K. Graham
(74) *Attorney, Agent, or Firm*—Fay, Sharpe, Fagan, Minnich & McKee, LLP; James C. Vago

(57) ABSTRACT

A toothbrush with a detachable/replaceable head, comprising a top section having a first aperture, a second aperture, a first end and a second end. The first end includes a notched portion. The first aperture extends from the top section first end along a length of the top section within the top section. The second aperture is located along a top surface of the top section, a bottom section having a first end and a second end. The first end includes a tabbed portion which matingly engages with the notched portion of the top section first end. The bottom section further includes an extension having a first end and a second end and a protrusion adjacent the extension first end wherein the extension is connected to the bottom section first end. The protrusion selectively cooperates with the second aperture in the top section to selectively lock and unlock the top and bottom sections. The extension is inserted into the first aperture of the top section. The extension can include a first section and a second section. The protrusion extends from the first section. The top section and bottom section can further include edges which selectively engage each other.

2 Claims, 3 Drawing Sheets

TOOTHBRUSH WITH DETACHABLE/ REPLACEABLE HEAD

BACKGROUND OF THE INVENTION

The present invention relates to the art of dental instruments. It finds more particular application in a disposable toothbrush where one would only have to dispose, replace, or interchange the top (brush) portion of the toothbrush. However, it will be appreciated that the invention has other applications, such as interchangeable home dental devices, i.e., a tooth pick top and a toothbrush top, which would expand the use of the bottom, handle portion. Further, it may be advantageously employed in other environments and applications.

Traditionally, there have been many varieties of toothbrushes which had disposable and interchangeable heads or disposable bristle sections. The reason for wanting disposable heads or brush sections would be either because the handle or gripping section was made from an expensive material, the handle or gripping portion had an ornamental design, or the top section had multiple instrumentalities or replacements. For example, the top section can have different nylon bristle stiffness replacements or interchangeable picking devices and brushes.

These previous toothbrushes have been hard to operate because their connection devices required a lot of strength or coordination to operate. There have been a plurality of connection or attachment devices to connect the top and bottom portions together. For example, there are male/female devices, which are inserted into each other, threaded devices, which screw together, sliding devices, which slide and lock together, similar to the male/female devices, and others known to those skilled in the art.

While certain connecting devices for connecting the top and bottom portions of a disposable toothbrush have been designed in an effort to overcome the foregoing deficiencies, they have not been successful. The problem with the prior art devices is that a person wants to be able to easily and securely attach and detach the top portion of the dental instrument from the bottom portion. With the screw type devices, this was difficult. It took a lot of effort and was difficult for some people with physical challenges to accomplish, making the replacement or interchangeability irrelevant. In the male/female devices, they were often times not secure enough to withstand the forces exerted on the connection during brushing, causing them to become loose. In contrast, other styles of male/female connectors were secured so tightly that they were very difficult to pull apart to replace or interchange the top portion. Further, when the top portion had the male section, there was too much force on the male section and it would sometimes break off.

The daily use suggestions for toothbrushes generally causes sufficient bristle wear that brush overuse is a fairly common problem. This is not only due to the normal reluctance and inconvenience of purchasing and replacing a toothbrush, but also because most users simply cannot determine themselves when the brush itself has become too worn. On the other hand, users have become accustomed to handles with replaceable tool heads for personal and oral hygiene such as razor blades, water picks and the like, so the prospect of having readily replaceable heads for a toothbrush is particularly convenient as an incentive to regularly change the brush head over time for better quality brushing.

The present invention contemplates a new and improved apparatus and method which overcomes the above-referenced problems and others.

SUMMARY OF THE INVENTION

The present invention relates to the art of dental instruments. More specifically, it relates to a toothbrush which has a disposable or replaceable head.

In the preferred embodiment, the dental device comprises a top section having a first aperture, a second aperture, a first end and a second end. The first end includes a notched portion. The first aperture extends into the top section from the first end, and the second aperture is located along a top surface of the top section between the top section first and second ends.

The dental device further comprises a bottom section having a first end and a second end. The bottom section first end includes a tabbed portion which matingly engages with the notched portion of the top section first end.

The dental device further includes an extension having a first end and a second end and a protrusion adjacent the extension first end. The extension second end is connected to the bottom section first end. The protrusion selectively cooperates with the second aperture in the top section to selectively lock and unlock the top and bottom sections when the extension is fully inserted into the first aperture of the top section. The protrusion extends beyond a top surface of the top section when the protrusion is fully engaged within the second aperture.

The bottom section further comprises a gripping portion located between the bottom section first end and second end. The top section further comprises a dental instrument such as a brush head located adjacent the top section second end.

The extension further comprises a first section and a second section which are generally parallel to each other. The first section has a first end and a second end. The protrusion is located adjacent the first section first end.

The first and second sections of the extension are deformable toward each other. A gap is formed between the extension first section and second section. The protrusion and the second section form a "T"-shaped cross section which ensures proper orientation of the bottom section and the top section, i.e., that the handle and brush head are properly aligned.

The top section and bottom section each further comprise an edge, wherein the top section edge is located at the top section first end. The bottom section edge is located at the bottom section first end. The top section edge and the bottom section edge cooperatively engage each other.

A main advantage of the present invention is that a top and bottom section of a dental device can be easily detached and attached to each other.

Another advantage is that the assembly is configured to maximize integral strength of the assembled components, while minimizing difficulty of the disassembly and reassembly process.

Another advantage of the present invention is that various brush heads or dental devices can be easily interchanged on a single bottom section.

Another advantage is that a plurality of identical brush heads can be used with the same handle over time to extend the useful life of the brush assembly and delay the need for replacement.

Other advantages and benefits of the present invention will become apparent to those of ordinary skill in the art upon reading and understanding the following detailed description of the preferred embodiment.

BRIEF DESCRIPTION OF THE DRAWINGS

The invention may take form in various components and arrangements of components, and in various steps and arrangement of steps. The drawings are only for purposes of illustrating the preferred embodiments and are not to be construed as limiting the invention.

DETAILED DESCRIPTION OF THE PREFERRED EMBODIMENT

Figure 1:
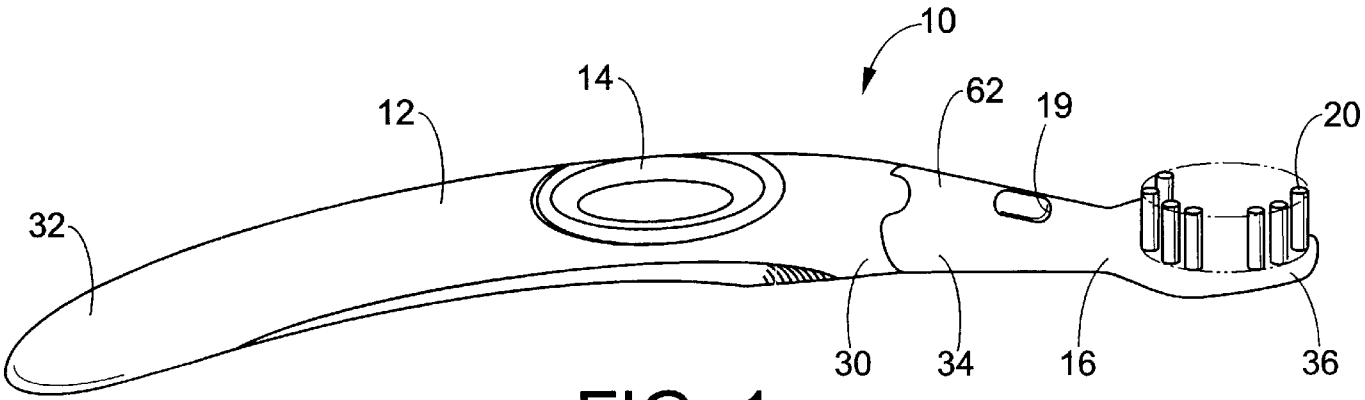
FIG. 1 illustrates an elevational view of the toothbrush in accordance with the preferred embodiment.

Turning now to the drawings, wherein the showings are for purposes of illustrating a preferred embodiment of the invention only and not for limiting the same, FIG. 1 shows a toothbrush 10. The toothbrush 10 has a bottom section or portion 12, which is used to grip the toothbrush 10, a thumb area or gripping portion 14, which aides in the gripping, and a top or brush section 16. The top section or portion 16 has a first aperture 18 and a second aperture 19. The bottom section or portion 12 has a first end 30 and a second end 32. The top section 16 has a first end 34 and a second end 36. A bristle section 20 is located at the second end 36 of the top section 16. The top section first aperture 18 extends from the top section first end 34 partially through the length of the top section 16. The second aperture 19 is located on a top surface 62 of the top section 16 between the top section first end 34 and second end 36.

Figure 2:
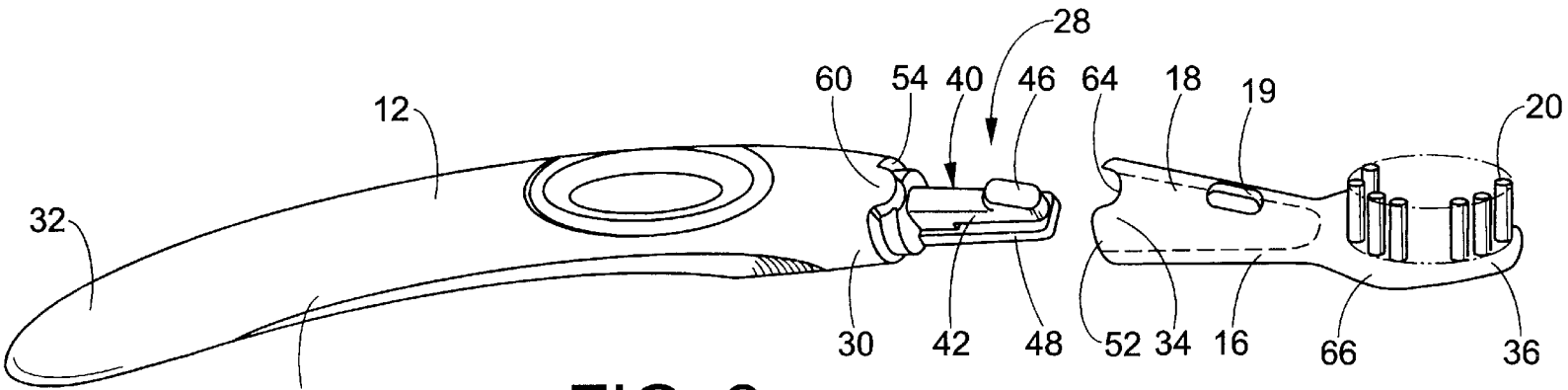
FIG. 2 illustrates an elevational view of the toothbrush of FIG. 1 with the top section and bottom section separated from each other.
Figure 3:
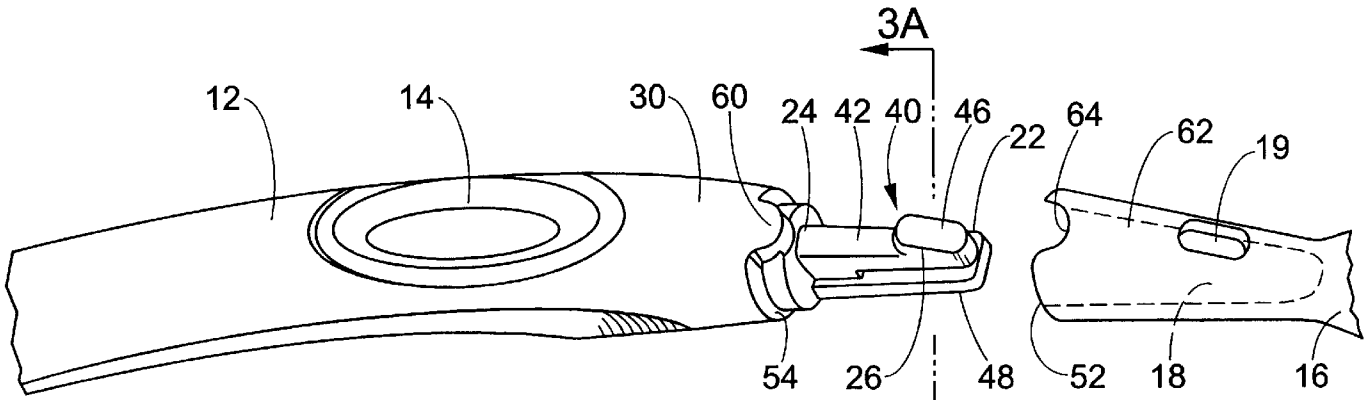
FIG. 3 illustrates an enlarged view of the connection system of the toothbrush of FIG. 1.

Turning to FIGS. 2–3, the toothbrush 10 is shown in a separated state. The toothbrush 10 has a connection system 28 which includes an extension 40 which extends from the first end 30 of bottom section 12.

As shown in FIG. 3, the extension 40 has a first end 22 and a second end 24. The second end 24 of the extension 40 is connected to the first end 30 of the bottom section 12. The extension 40 includes a first section 42 and a second section 48 which are generally parallel to each other. The first section 42 includes a protrusion or detent 46 which is located adjacent the top end 26 of the first section 42.

Figure 4:
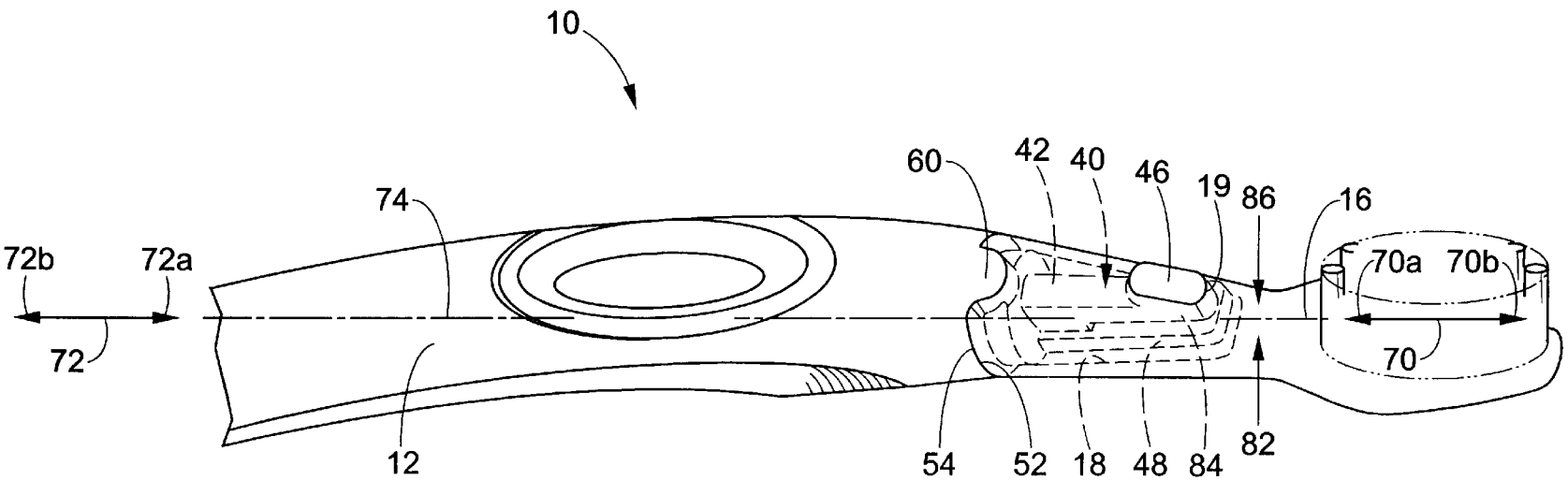

Further, an edge 52 of the top section 16 cooperatively engages an edge 54 of the bottom section 12, as can be seen in FIG. 4, when the connection system 28 secures the top section 16 and bottom section 12 together. The top section edge 52 is located at the top section first end 34. The bottom section edge 54 is located at the bottom section first end 30.

The bottom section 12 further includes a tabbed portion 60 located at the bottom section first end 30. The top section 16 has a notched portion 64 located at the top section first end 34. The tabbed portion 60 cooperatively engages the corresponding notched portion 64 when the top section 16 and bottom section 12 are secured together. The tab and notch sections allow better engagement of the top and bottom sections and help the user orient the top and bottom section for proper installation of a brush head 66 located at the top section second end 36 with respect to a handle 68 located at the bottom section second end 32.

Figure 3B:
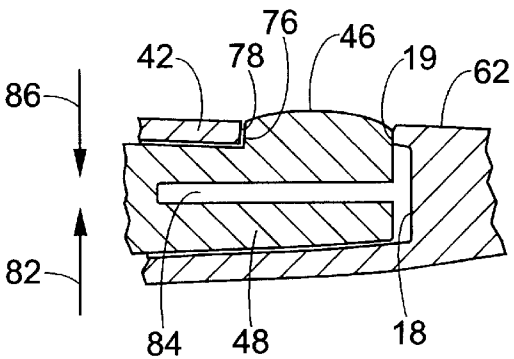
FIG. 3B illustrates a side cross-sectional view of the extension of the toothbrush of FIG. 1; and, FIG. 4 illustrates an elevational view of the connection system shown in phantom installed in the toothbrush of FIG. 1.
Figure 3A:
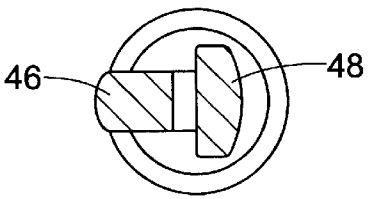
FIG. 3A illustrates a top cross-sectional view of the extension of the toothbrush of FIG. 1.

Referring to FIG. 3A, the extension 40 is shaped in a "T" cross section to eliminate the ability to insert the detachable top section 16 onto the handle bottom section 12 in any other orientation other than the correct one that will lock the top section 16 onto the bottom section 12 firmly. Specifically, protrusion 46 and the second section 48 form a "T" cross section. As shown in FIG. 3B, a gap 84 separates the first section 42 from the second section 48.

During installation of the bottom section 12 onto the top section 16, the extension 40 slides into and engages the first aperture 18 of the top section 16. The protrusion 46 is depressed to slide into the first aperture 18. Then, the protrusion 46 snaps out into the second aperture 19 in top section 16. As the extension 40 is being inserted into the first aperture 18, the protrusion 46 forces first section 42 to bend or deform toward second section 48. As the extension 40 is pushed farther into the first aperture 18, the second section 48 is forced to bend or deform upward in direction of arrow 82 into gap 84 (shown in FIG. 3B) while the first section 42 is being forced to bend downward in direction of arrow 86 into gap 84 until the protrusion 46 is fully received in second aperture 19. The protrusion 46 extends into the second aperture 19, thus locking the bottom section 12 to the top section 16. As shown in FIG. 3B, the face of the protrusion 46 extends out past the top surface 62 of the top section 16 when the protrusion 46 is fully engaged within the second aperture 19.

To remove the top section 16 from the bottom section 12, the user must depress the protrusion 46 into the second aperture 19 until the protrusion 46 is below the top surface 62 of the top section 16. Then, the extension 40 is pulled out of the top section 16 through the first aperture 18.

Turning now to FIG. 4, a cross-sectional view of the toothbrush 10 is shown where the connection system 28 secures the bottom section 12 and top section 16 together.

The top section 16 and bottom section 12 are pushed together by a user through an exertion of force 70 on the top section 16 and force 72 on the bottom section 12 along a longitudinal central axis 74 of the toothbrush 10. When connecting the top section 16 and bottom section 12 of the toothbrush 10, the forces 70 and 72 are exerted toward each other in directions 70*a* and 72*a* along the axis 74. When disconnecting the top section 16 and bottom section 12, the forces 70 and 72 are exerted away from each other in directions 70*b* and 72*b* along longitudinal axis 74.

The extension 40 is preferably made from a plastic or flexible material whose deformable rigidity is designed in accordance with the amount of force desired to enable locking and unlocking of the connection system 28. The protrusion 46 is preferably rounded instead of having any vertical edges, which allows for the protrusion 46 to easily unlock from the second aperture 19. When there are pulling forces 70*b* and 72*b*, the protrusion 46 will force the first section 42 and second section 48 to deform in shape, similarly to the stages described above. When the gap 84 is small enough, an edge 76 of the protrusion 46 slides down an edge 78 of the second aperture 19 releasing the protrusion 46 from the second aperture 19 and unlocking the connection system 28. Then the user can fully remove the brush top section 16 from the handle bottom section 12.

The preferred embodiment is for a toothbrush 10 which can have either a handle bottom section 12 made from expensive materials or made from an ornamental design. It is to be appreciated that the top section 16 can be other brush systems with different rigidities of nylon-like, or other type, bristles. Further, the top section 16 can be other household dental instruments such as a metal or plastic tooth pick device. It could be other toiletry devices, such as a razor or comb. In that case, a user can perform several dental and hygienic functions easily by simply pulling off one instrument and replacing it with another.

The preferred embodiment also contemplates having a supply of toothbrush heads which are periodically replaced. The expense of manufacturing only the heads is less expensive than the whole toothbrush. Therefore, the replacement heads would be less expensive to a consumer than having to purchase a new toothbrush every three months. Further, since the replacement heads are much smaller than the entire toothbrush, environmentally there would be less waste disposed of when the bristles of the toothbrush wear out and need to be replaced.

With this toothbrush 10 it is possible for a person to easily perform multiple hygienic functions while also having a good grip on the ornamental or expensive handle bottom section 12, where the grip is aided by the thumb gripping section 14. The force of the brushing is distributed throughout the connection system 28 so that the top section 16 is secured with high friction onto the bottom section 12, and is still easily replaceable. Therefore, although the connection system 28 can be easily unlocked or disconnected, the connection 28 will hold up to very hard brushing. Further, edges 52 and 54 add an extra amount of security and strength to the connection through their design and interaction to allow for hard brushing without the connection 28 becoming loose. More particularly, the tab and notch portions 60 and 64 enhance the locking action between the top section 16 and bottom section 12 and ensure that the user properly orients the head to the handle portion.

The invention has been described with reference to the preferred embodiment. Obviously, modifications and alterations will occur to others upon reading and understanding the proceeding detailed description. It is intended that the invention be construed as including all such modifications and alterations insofar as they come within the scope of the appended claims or equivalents thereof.

Having thus described the preferred embodiment, the invention is now claimed to be:

1. A dental device, comprising:

a top section having a first aperture, a second aperture, a first end and a second end, said first end includes a notched portion, said first aperture extends from said top section first end along a length of said top section within said top section, said second aperture is located on a surface of the top section;

a bottom section having a first end and a second end, said first end includes a tabbed portion which matingly engages with the notched portion of said top section first end; and an extension having a first end and a second end and a protrusion adjacent said extension first end wherein said extension second end is connected to said bottom section first end and wherein said protrusion selectively cooperates with said second aperture in the top section to selectively lock and unlock the top and bottom sections, the extension including a first section and a second section which are generally parallel to each other, said first section having a first end and a second end wherein said protrusion is located adjacent the first section first end, and wherein the extension second section and the protrusion form a "T" cross section which facilitates installation of the top section onto the bottom section in the proper orientation.

2. A dental device, comprising:

a top section having a first aperture, a second aperture, a first end and a second end, said first end includes a notched portion, said first aperture extends from said top section first end along a length of said top section within said top section, said second aperture is located along a top surface of the top section;

a bottom section having a first end and a second end, said first end includes a tabbed portion which matingly engages with the notched portion of said top section first end; and, an extension having a first end and a second end wherein said extension second end is connected to said bottom section first end;

the extension further comprises a first section and a second section which are generally parallel to each other, said first section has a first end and a second end and wherein a protrusion is located adjacent the first portion first end, said protrusion selectively cooperates with said second aperture in the top section to selectively lock and unlock the top and bottom sections, wherein the extension second section and the protrusion form a "T" cross section which facilitates installation of the top section onto the bottom section in the proper orientation, wherein said extension is inserted into said first aperture of said top section;

wherein said top section and bottom section each further comprise an edge, wherein said top section edge is located at said top section first end and said bottom section edge is located at the bottom section first end, wherein said top section edge and said bottom section edge cooperatively engage each other.

* * * * *